United States Patent [19]

Kim

[11] Patent Number: 4,940,269

[45] Date of Patent: Jul. 10, 1990

[54] EXTENSION UNIT FOR DOOR LOCK

[75] Inventor: Won Se Kim, Seoul, Rep. of Korea

[73] Assignee: Hyundae Metal Co., Ltd., Daegu, Rep. of Korea

[21] Appl. No.: 253,148

[22] Filed: Oct. 4, 1988

[30] Foreign Application Priority Data

Oct. 5, 1987 [KR] Rep. of Korea ..... 87-17293[U]

[51] Int. Cl.[5] ..... E05B 9/00

[52] U.S. Cl. ..... 292/337; 292/1

[58] Field of Search ..... 292/337, D44, D60, 1, 292/D74, 169, 169.13, 169.22, 169.23

[56] References Cited

U.S. PATENT DOCUMENTS

| | | | |
|---|---|---|---|
| 2,250,036 | 7/1941 | Schlage | 70/DIG. 3 |
| 2,299,181 | 10/1942 | Schlage | 70/DIG. 3 |
| 2,674,481 | 4/1954 | Russell et al. | 292/337 X |
| 2,776,155 | 1/1957 | Gerlach | 292/1 |
| 3,046,042 | 7/1962 | Kane | 292/1 |
| 3,190,638 | 6/1965 | Schlage | 292/337 |
| 3,300,240 | 1/1967 | Tornoe et al. | 292/337 |
| 4,372,594 | 2/1983 | Gater | 292/D44 |
| 4,729,586 | 3/1988 | Fang | 292/D60 X |
| 4,744,232 | 5/1988 | Shen | 292/337 X |

*Primary Examiner*—Gary L. Smith
*Assistant Examiner*—Michael Milano
*Attorney, Agent, or Firm*—Lieberman, Rudolph & Nowak

[57] ABSTRACT

An extension unit for a door lock in which it is possible to readily change the backset of the door lock unit to accommodate standard backsets of $2\frac{3}{8}$ inches and $2\frac{3}{4}$ inches. The extension unit comprises an extension element, a connector element and a housing element, all of which, in combination, permit the backset to be easily and readily changed.

4 Claims, 4 Drawing Sheets

EXTENSION UNIT FOR DOOR LOCK

FIELD AND BACKGROUND OF THE INVENTION

This invention relates to an extension unit for a door lock, and more particularly to an extension unit that can be added to a conventional latch unit to adjust the backset of the latch unit.

Generally speaking, a door lock comprises a latch tube having a latch bolt and a guard bolt, with the latch tube being connected to a latch actuating unit. Such a door lock typically has two standard backsets, with backset being defined as the distance from the door edge to the axis of the knob. Standard backsets are usually either 2⅜ inches (60 mm), or 2¾ inches (70 mm).

In order to supply a latch unit that will accommodate both standard backsets, prior art designs had to supply, on the same production line, a respective latch unit comprising the same components, but differing only in backset length. Consequently, prior art latch units resulted in inefficient production, high cost, and inconvenience in manufacture, sales and distribution.

Numerous prior art means have been used to make a latch unit assembly in which the backset can be transformed by interposing various types of extensions, or changing the structure of the latch tube to provide an increased backset between the rear of the latch tube having a standard backset and the latch bolt actuating unit.

An example of such prior art is shown in U.S. Pat. No. 3,046,042, issued July 24, 1962, to J. F. Kane. While this is designed to increase the backset of a conventional latch bolt unit by securing an extension unit consisting of an extension link, a latch bar extension, and a cylindrical housing, it has some disadvantages.

The extension unit, because of its complicated components, must be handled many times in manufacturing. Also, the unit employs direct reciprocating movement of the latch bar extension utilizing only a pair of finger elements which may result in reducing the life, or limiting the operational efficiency of the extension unit.

Another prior art patent, U.S. Pat. No. 4,496,178, issued Jan. 29, 1985 to W. E. Best et al, discloses an extension tube which is riveted to a conventional latch tube in order to provide an increased backset. However, said extension tube, which comprises a cross bar, a connector, etc., is of complicated construction and is integrally riveted to the latch tube. Therefore, transformation to a latch unit with an extended backset or replacement of the latch tube with another backset cannot be easily accomplished. As a result, the manufacturing process for making this latch tube with different backsets requires separate manufacturing steps, thereby lowering production efficiency.

Still another prior art patent is U.S. Pat. No. 4,653,787, issued Mar. 31, 1987, to Y. P. Fang. This patent discloses a backset-adjustable latch of a cylindrical lock which can transform a latch with a backset of 2⅜ inches (60 mm) to a backset measuring 2¾ inches (70 mm).

Backset is adjusted simply by pressing down a case fixing button located on the extension case, whereby the extension case is extended to provide an increased backset.

The Fang patent discloses specific components, e.g., a latch bolt extension slide, a guard bolt extension slide, and a retractor slide, which components, in combination, provide a latch unit with increased backset. From a manufacturing point of view, while this patent has a convenient extension mechanism, it contains many complicated components in order to provide adjustable backset and, thus, results in a waste of time and effort in the manufacturing procedures.

It is, therefore, an object of the present invention to provide an extension unit for a door lock which can transform a latch unit with a backset of 2⅜ inches, to a backset of 2¾ inches, and advantageously be easily removed or secured to the endwall of the latch tube.

It is a still further object of the present invention to provide an extension unit which is simply constructed for efficient manufacturing and for ease of handling.

SUMMARY OF THE INVENTION

Generally, the latch unit for use in accordance with the instant invention is designed for assembly to a latch bolt actuating unit. This latch unit is comprised of a latch tube having an auxiliary plate and a face plate which has two screwholes for installing at the edge of the door, a latch bolt and a guard bolt, which are resiliently received within the latch tube and extended through the face plate, a back plate having a central slot and an out-turned ear which extends through an upper and a lower opening of an aperture formed on the endwall of the latch tube, and a latch bar connected to the latch bolt and extended through said aperture of the latch tube, as well as the central slot of the back plate.

The latch bolt actuating unit is comprised of a cylinder case having a retractor therein, which is connected to the knob of the door lock.

The extension unit, in accordance with the present invention, is assembled between a latch tube of any desired construction, and a latch bolt actuating unit, and the extension unit consists of an extension element, a connecter element, and a housing element.

In accordance with a feature of the present invention, the extension element is comprised of a hook extending from an upper and lower surface of a frame which has a rectangular channel therein for the engagement with an out-turned ear of the latch unit back plate. A protrusion and an ear are located behind the hook on the frame for receiving the cylinder case of the latch bolt actuating unit, and a front and two rear ribs are integrally formed on the periphery of the frame.

The connector element, in accordance with the present invention, is comprised of a body which is fitted within the channel of said extension element, said body being formed into a U-shaped wing having a notch corresponding to a predetermined portion of the latch bar. An opening formed on the front surface of the body has a shoulder for engagement with a notch of the latch bar.

In the extended latch unit, the hook of the extension element is engaged with the out-turned ear of the latch tube having a backset of 2⅜ inches. The shoulders of the connector element are secured to the notch of the latch bar respectively. Next, the housing element with a prepositioned slit portion is placed longitudinally over the outer periphery of the extended latch unit. Thus, such an arrangement provides a latch unit with an increased backset of 2¾ inches.

These and other objects and features of the invention will be more fully appreciated from the following detailed description when taken in conjunction with the accompanying drawings in which:

DETAILED DESCRIPTION OF THE PREFERRED EMBODIMENT

Figure 1:
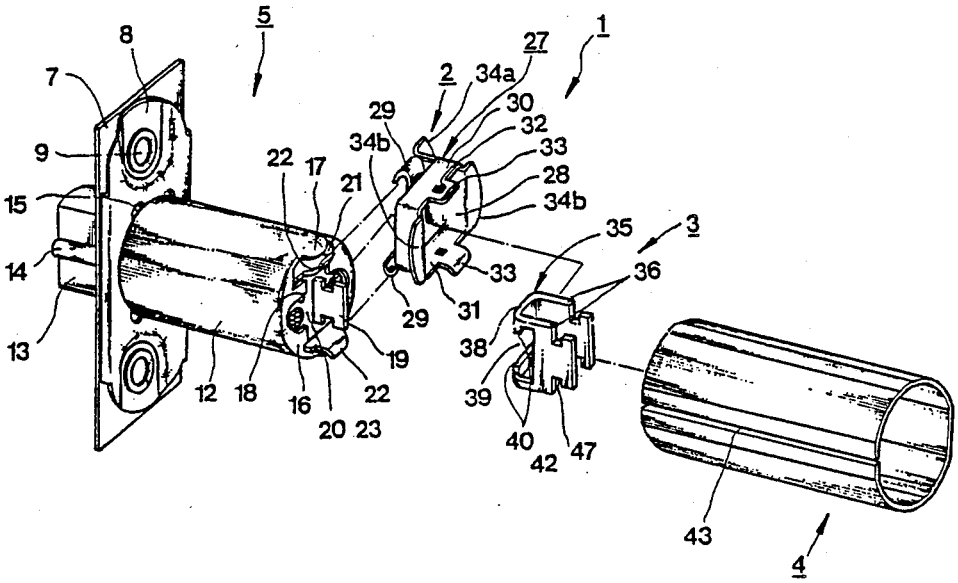
FIG. 1 is an exploded perspective view illustrating the extension unit in accordance with the present invention, to be assembled to a conventional latch unit with a backset of $2\frac{3}{8}$ inches.

An extension unit indicated at 1 shown in FIGS. 1–4, comprises an extension element 2, a connector element 3, and a housing element 4. The extension unit 1 is assembled between a conventional latch unit with a backset of $2\frac{3}{8}$ inches designated at 5 and a latch bolt actuating unit 6 described below.

Generally, the latch unit 5 comprises a face plate 7 and an auxiliary plate 8 having two screwholes 9 which are secured by screws (not shown) to the edge 10 of the door 11. Also included is a cylindrical latch tube 12 in which a latch bolt 13 and a guard bolt 14 are resiliently installed on top of a spring (not shown). The latch bolt 13 and the guard bolt 14 are adapted to be projected through said face plate 7.

The latch tube 12 is formed in the shape of a deep-drawn cylinder with a flange 15 at its opened outer end, and an endwall 16 at its closed inner end. The endwall 16 is formed with a lug 17, as well as an aperture 18, which permits a latch bar 19, as described below, to pass through. The aperture 18 is integrally formed with an upper and a lower opening **18*a* and 18*b*. The inner surface of the endwall 16 is seated against a back plate 20, having a central slot 21, which also permits latch bar 19 to pass through, as well as out-turned ear 22. The out-turned ear 22 also projects through the upper and lower opening 18*a* and 18*b* of the aperture 18**.

Figure 5:
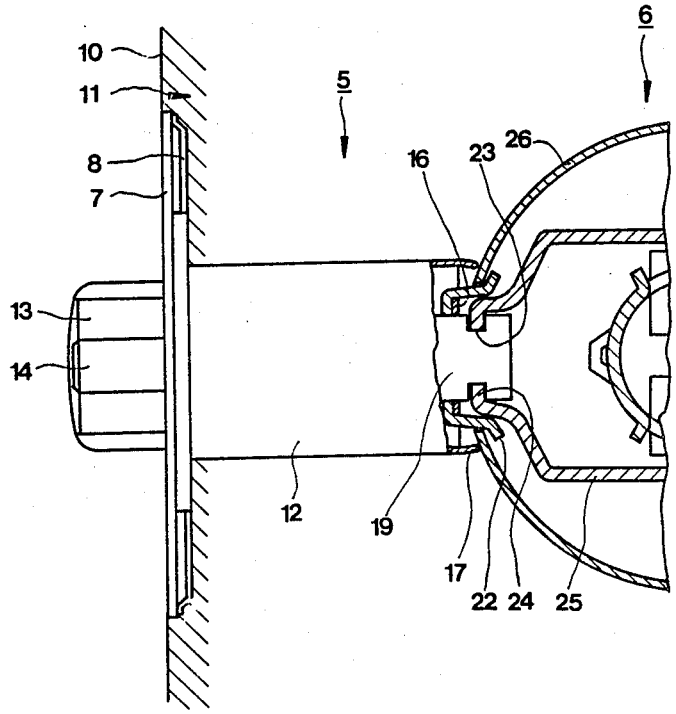
FIG. 5 is a view similar to FIG. 4, but showing the conventional latch unit assembled to the latch bolt actuating unit.
Figure 6A:
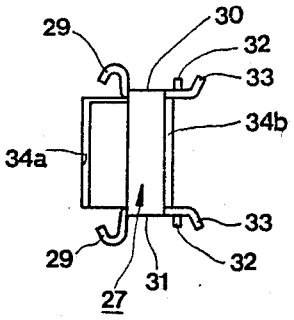
FIG. 6A is a front view of the extension element in accordance with the present invention.
Figure 6B:
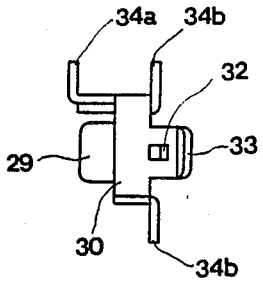
FIG. 6B is a top plan view of the extension element in accordance with the present invention.
Figure 7A:
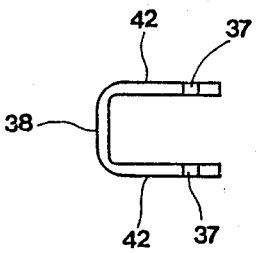
FIG. 7A is a top plan view of the connector element in accordance with the present invention.
Figure 7B:
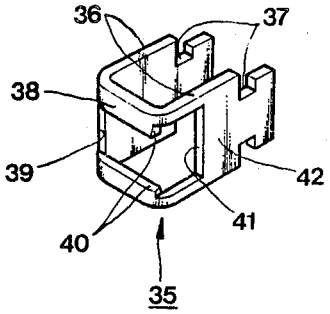
FIG. 7B is a perspective view of the connector element in accordance with the present invention.

When the backset of the door is $2\frac{3}{8}$ inches, the latch unit 5 is directly assembled to the latch bolt actuating unit 6 as shown in FIG. 5. The latch bar 19, having outwardly opened notch 23, is adapted to receive fingers 24 formed on the retractor 25 of the latch bolt actuating unit 6. In addition, the cylinder case 26 of the latch bolt actuating unit 6 is engaged between lug 17 of endwall 16, and the out-turned ear 22 of latch tube 12.

Accordingly, for normal operation, movement of retractor 25 in FIG. 5 in response to rotation of a knob retracts or extends latch bolt 13 and guard bolt 14 in the latch tube 12.

When the backset of the door is $2\frac{3}{4}$ inches, the extension element 2 is engaged with out-turned ear 22 of latch tube 12, and connector element 3 is engaged with notch 23 of latch bar 19. Finally, retractor 25 of the latch bolt actuating unit 6 is engaged with the notch described below) of connector element 3, so as to increase the length of the latch tube 12.

As shown in FIGS. 1–4, 6A and 6B, the extension element 2 consists of a frame 27 which is formed with a generally rectangular channel 28 therein. A hook 29 is formed on the upper and lower surface 30 and 31 of the frame 27, and adapted to be engaged with the out-turned ear 22 of latch tube 12. A protrusion 32 and an ear 33, which are designed to receive the cylinder case 26 of the latch bolt actuating unit 6, are integrally formed behind the hook 29 on the upper and lower surface 30 and 31 of frame 27.

In addition, frame 27 has a front rib **34*a* and two rear ribs 34*b* on its periphery except the upper and lower surface 30 and 31. The front rib 34*a* is formed on only one side of frame 27 for providing a passage to permit the extension element 2 to be smoothly assembled to the out-turned ear 22 of latch tube 12. However, rear ribs 34*b* are formed on both sides of frame 27, with the front rib 34*a* and the rear ribs 34*b* being parallel with each other. The outer edge portions of ribs 34*a* and 34*b* have the same curvature which corresponds to the internal curvature of housing element 4**.

Accordingly, when the extension unit 1 is completely assembled to the latch unit 5, the ribs **34*a* and 34*b* abut against the inner surface of the housing element 4**, thereby preventing any loosening of the engagement of the assembled components thereto.

The connector element 3 has a body 35, which is adapted to fit within channel 28 of said extension element 2, as shown in FIGS. 1, 4, 7A and 7B. The body 35 is formed with a pair of backward projecting U-shaped wings 36 having notches 37 at its outer ends, which are adapted to receive the fingers 24 of the retractor 25. On the front surface 38 of body 35, is an opening 39 provided with shoulder 40 for engagement with notch 23 of latch bar 19, which latch bar 19 can pass through the opening 39.

The opening 39 is adjacent to another opening 41, which is formed on the side surface 42 of body 35 to receive the outer end of latch bar 19, when connector element 3 is assembled to, or disassembled from, latch bar 19.

As shown in FIG. 1, housing element 4 has a longitudinal slit 43 along its entire length, and covers latch unit 5 and extension unit 1 assembled thereto. Therefore, housing element 4 protects the interior components, prevents their disengagement, and provides convenience in handling.

Figure 2:
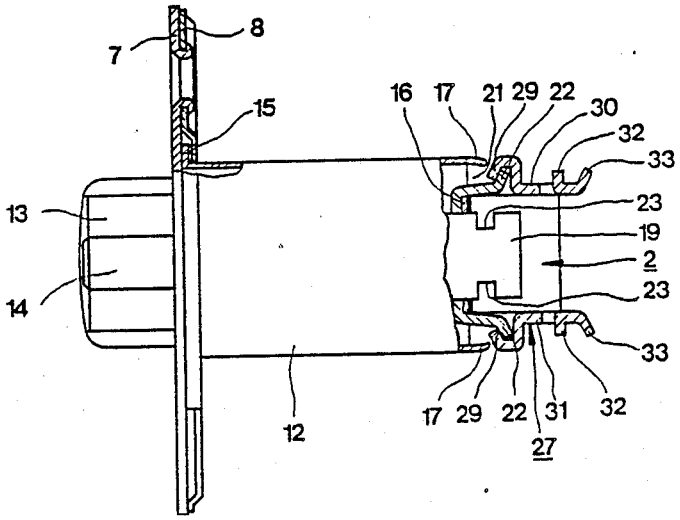
FIG. 2 is a partially sectional view illustrating the extension element in accordance with the present invention, to be engaged with the out-turned ear of the conventional latch unit.

Referring now to FIG. 2, there is shown only the extension element 2 being attached to the rear of latch unit 5, with a backset of $2\frac{3}{8}$ inches. The hook 29, formed on the upper and lower surfaces 30 and 31 of frame 27 is engaged with out-turned ear 22, which is projected through the upper and lower opening **18*a* and 18*b* of aperture 18 formed on endwall 16 of latch tube 12. As a result, the latch unit 5 is increased in length by the length of said extension 2** to a backset of $2\frac{3}{4}$ inches.

Figure 3:
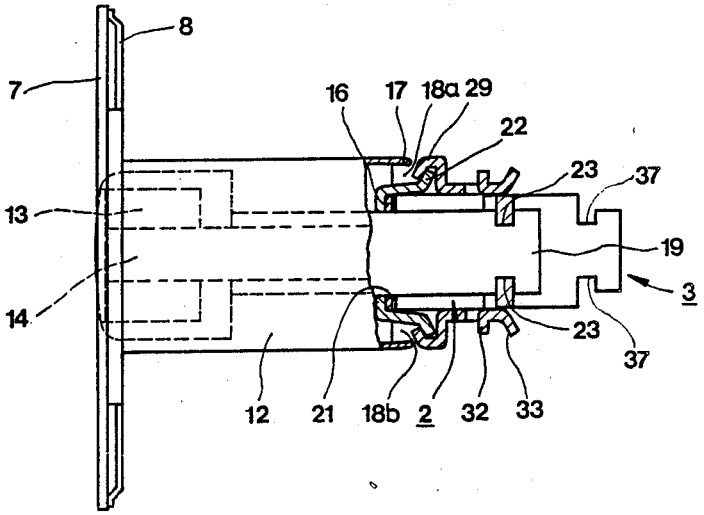
FIG. 3 is a view similar to FIG. 2, but showing a latch bolt pulled backward to the operation position.

Similarly, as shown in FIG. 3 latch bar 19, which is connected to latch bolt 13, slidably protrudes beyond the rear of said extension element 2 in response to the backward pull of latch bolt 13 into latch tube 12.

The shoulder 40 of connector element 3 is fitted into notch 23 of latch bar 19 through the openings 39 and 41. When latch bolt 13 is released, the latch bolt 13 and guard bolt 14 are returned to their released position by means of the resilient force of a spring (not shown). In this position, latch bolt 13 and the guard bolt 14 are projected over the face plate 7.

As latch bolt 13 is moved forward by the resilient force of the spring (not shown), the latch bar 19 is also moved forward together with connector element 3, and shoulder 40 of connector element 3 is received within notch 23 of latch bar 19. The connector element 3 thus fits within channel 28 of extension element 2, and notch 37 formed on the end of wing 36 is projected backward over the extension element 2 as shown in FIG. 3.

Figure 4:
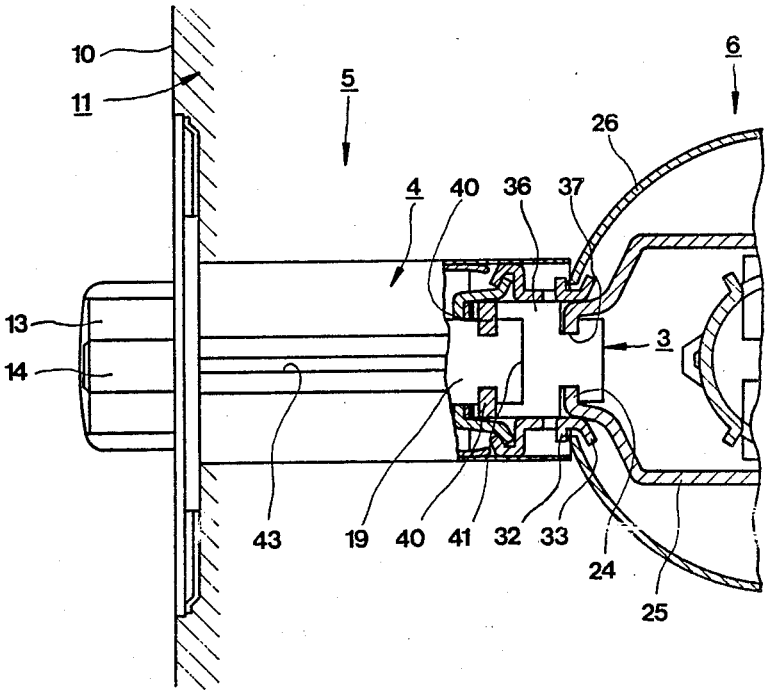
FIG. 4 is a partially sectional view illustrating the extension element, connector element, and housing element completely assembled to provide a latch unit with a backset of $2\frac{3}{4}$ inches.

As shown in FIG. 4 the latch unit 5, when assembled with extension unit 1, is completely connected to the latch bolt actuating unit 6, as finger 24 of retractor 25 is received in notch 37 of the connector element 3. At the same time, cylinder case 26 of the latch bolt actuating unit 6 is engaged between protrusion 32 and ear 33 of extension element 2.

Therefore, the backset of the assembled latch is increased to $2\frac{3}{4}$ inches because the length of the extension element 2 compensates for the shortage of latch unit 5, and is accordingly applicable for a door lock having a backset of $2\frac{3}{4}$ inches.

In order to disassemble extension unit 1 from latch unit 5, to provide a latch unit with a backset of $2\frac{3}{8}$ inches, latch bolt 13 must first be pushed against face plate 7 so as to project connector element 3, which is engaged with notch 23 of latch bar 19, from channel 28 of extension element 2.

Next, shoulder 40 of connector element 3 is disengaged from notch 23 of latch bar 19, and said connector element 3 is pushed through the openings 39 and 41.

Finally, hook 29 of the extension element 2 is released from the out-turned ear 22 of latch tube 12.

As described above, it will be appreciated that the extension unit 1, in accordance with the present invention, advantageously does not affect the normal operation of latch unit 5. The simple construction of the extension unit of the instant invention provides easy assembly and disassembly of any latch unit having both a latch bar 19 and an out-turned ear 22.

The foregoing disclosure and description of the invention is illustrative and explanatory thereof, and various changes in the size, shape and materials, as well as in the details of the illustrated construction, may be made within the scope of the appended claims without departing from the spirit of the invention.

I claim:

1. An extension unit for a door lock in combination with a latch unit consisting of a latch tube secured to an auxiliary plate and a face plate, said face plate having two screwholes for attaching said door lock to an edge of a door, a latch bolt and a guard bolt resiliently installed within said latch tube, a back plate affixed to said latch tube and having a central slot and an out-turned ear projected through an upper and a lower opening of an aperture of said latch tube, and a latch bar connected to said latch bolt and passed through said aperture, as well as said central slot, characterized in that there is further included an extension unit comprising;

a single extension element consisting of at least one hook for engaging with said out-turned ear of said back plate, said hook being formed on a surface of a frame, said frame further including a channel, a protrusion and an ear for accepting a cylinder case of a latch bolt actuating unit, said extension element further including front and rear ribs formed on opposite portion of said frame wherein said rear ribs are provided on both sides of said frame;

a connector element consisting of a body which fits within said channel of said extension element frame, the body being provided with two wings, with each wing having a notch at an end portion thereof, a first opening in said connector element, said first opening having a shoulder formed on a front surface of said body for engaging with a notch of said latch bar, and a second opening being interconnected with said first opening thereof, said second opening accepting an end of said latch bar at a side surface thereof; and a housing element having a longitudinal slit, said housing element covering the entire length of said latch unit.

2. An extension unit for a door lock in accordance with claim 1, wherein said front rib is provided on a first side of the frame.

3. An extension unit for a door lock in accordance with claim 1, wherein said front rib and said rear ribs are parallel and have the same relative curvature with respect to each other.

4. An extension unit for a door lock in accordance with claim 1, wherein said wings are parallel and interconnected at said front surface of said body.

* * * * *